US007186444B2

(12) United States Patent
Putkisto et al.

(10) Patent No.: US 7,186,444 B2
(45) Date of Patent: Mar. 6, 2007

(54) ELECTROSTATIC COATING DEVICE WITH INSULATED GROUNDING ELECTRODE

(75) Inventors: Kaisa Putkisto, Tampere (FI); Juha Maijala, Järvenpää (FI); Veli Käsmä, Tampere (FI)

(73) Assignee: Metso Paper, Inc., Helsinki (FI)

( * ) Notice: Subject to any disclaimer, the term of this patent is extended or adjusted under 35 U.S.C. 154(b) by 12 days.

(21) Appl. No.: 10/507,240

(22) PCT Filed: Mar. 11, 2003

(86) PCT No.: PCT/FI03/00183

§ 371 (c)(1),
(2), (4) Date: Jan. 11, 2005

(87) PCT Pub. No.: WO03/077371

PCT Pub. Date: Sep. 18, 2003

(65) Prior Publication Data

US 2005/0167132 A1 Aug. 4, 2005

(30) Foreign Application Priority Data

Mar. 14, 2002 (FI) ..... 20020479
Sep. 16, 2002 (FI) ..... 20021651

(51) Int. Cl.
*B05D 1/06* (2006.01)
*B05B 5/025* (2006.01)
*B05B 5/14* (2006.01)

(52) U.S. Cl. ..... 427/482; 427/475; 427/485; 118/623; 118/630; 118/638

(58) Field of Classification Search ..... 427/475, 427/482, 485; 118/623, 630, 638
See application file for complete search history.

(56) References Cited

U.S. PATENT DOCUMENTS

| | | | | |
|---|---|---|---|---|
| 3,248,253 | A | 4/1966 | Barford et al. | |
| 4,060,648 | A * | 11/1977 | Taylor-Brown et al. | 427/482 |
| 6,624,413 | B1 | 9/2003 | Klein | |
| 6,648,972 | B1 | 11/2003 | Stober et al. | |
| 2002/0119255 | A1* | 8/2002 | Divigalpitiya et al. | 427/421 |

FOREIGN PATENT DOCUMENTS

| | | |
|---|---|---|
| DE | 198 36 022 A1 | 2/2000 |
| EP | 0 782 934 A1 | 7/1997 |
| FR | 1 312 830 | 12/1962 |
| GB | 1 017 576 | 1/1966 |
| WO | WO 00/03092 A1 | 1/2000 |
| WO | WO 03/077371 A2 | 9/2003 |
| WO | WO 03/077371 A3 | 9/2003 |

OTHER PUBLICATIONS

Liberto, N.P. (ed.) "Powder Coating The Complete Finisher's Handbook", pp. 86-89, 1994.*
International Preliminary Examination Report issued in PCT/FI03/00183.

* cited by examiner

*Primary Examiner*—Fred J. Parker
(74) *Attorney, Agent, or Firm*—Stiennon & Stiennon

(57) ABSTRACT

A powdery layer is formed on a first side of a web (W) which serves as a substrate by applying electrically charged particles on the web while a rotating grounding electrode is located at a second side of the web.

17 Claims, 1 Drawing Sheet

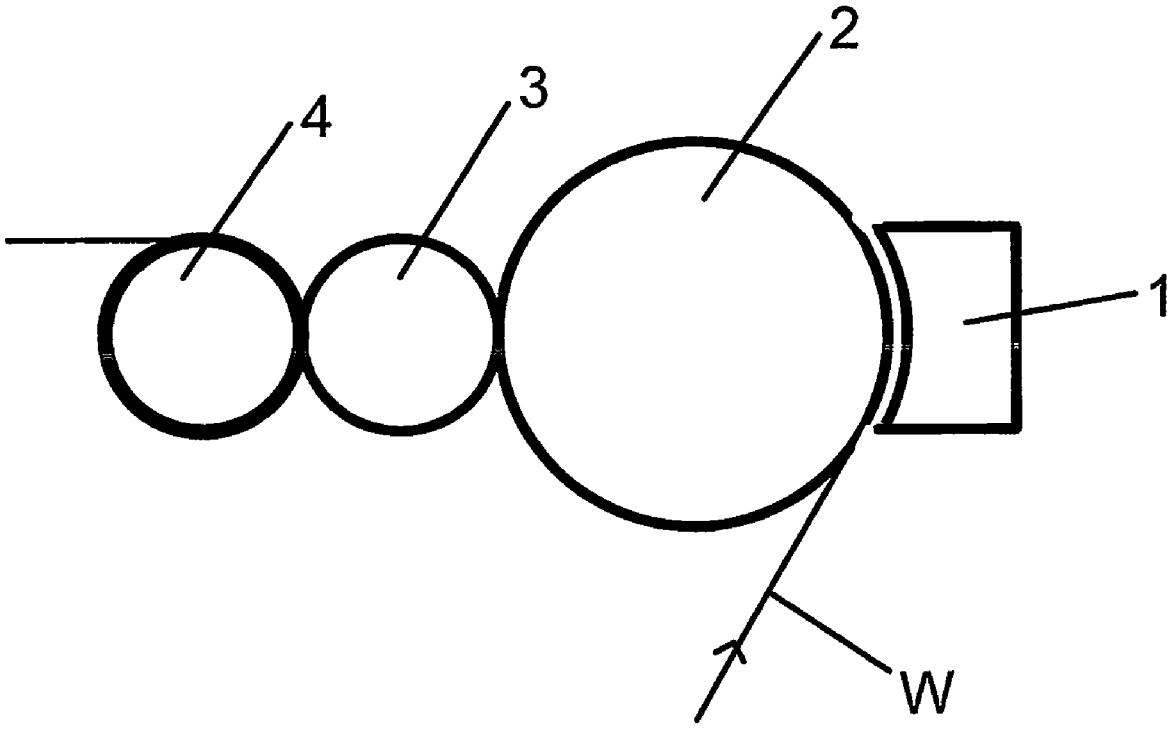
Fig.

ELECTROSTATIC COATING DEVICE WITH INSULATED GROUNDING ELECTRODE

CROSS REFERENCES TO RELATED APPLICATIONS

This application is a U.S. national stage application of International application No. PCT/FI03/00183, filed Mar. 11, 2004, and claims priority on Finnish Application No. 20020479, filed Mar. 14, 2002, and on Finnish Application No. 20021651, filed Sep. 16, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a grounding electrode of a process in which a moving web having a first side and a second side is arranged to serve as a substrate, and a powdery layer is arranged to be formed on the first side of the web by applying electrically charged particles on the web while the grounding electrode is arranged to be located at the second side of the web. The present invention also relates to a method for forming a powdery layer from powdery particles on a surface of a continuous web comprising steps of: Allowing the web having a first side and a second side to move between at least one charging unit of the powdery particles at the first side of the web, and at least one grounding electrode at the second side of the web being in a ground potential or another predetermined potential, applying on the first side of the web powdery particles, which are electrically charged in the charging unit, and finishing the powdery layer.

The known grounding electrodes used in this context have been stationary electrodes, such as electrically conductive plates.

A problem related to the method using the stationary grounding electrode with a moving web is that the particles of the dry powder tend to accumulate due to the stationary grounding electrode. The charged particles may tend to cake on the web at the location of the leaving edge of the grounding plate. A part of the charged particles remain in the sphere of influence of the grounding electrode, and do not move forward with the substrate. The phenomenon can be seen as a bubbling of the charged particles at the location of the edge of the stationary grounding electrode. As a consequence, an uneven powdery layer is formed on the substrate, and it can be seen as streaks on the surface of the substrate.

SUMMARY OF THE INVENTION

The device of the invention overcomes the defects of the prior art. The grounding electrode of the invention and the method of the invention are characterized in that the grounding electrode is a rotating device.

By using the rotating device the above-mentioned problems can be avoided, and a powdery layer without unevenness can be achieved. The rotating device can be for example a grounding roll, an endless conductive wire, or belt. A prerequisite for all the devices is that they must be electrically conductive at least partly.

The grounding electrode of the invention is used in a process in which electrically charged powdery particles are applied on a substrate by utilizing electric forces. The substrate is preferably a continuous web. The continuous web may be a web to be coated, or a surface onto which a film is formed and peeled off as a ready product. There is a wide variety for the material of the web; it may comprise papermaking fibers, for example chemical pulp and/or mechanical pulp, or it may be plastic, metallic, or a metal-coated plastic material.

The powdery particles may comprise inorganic particles, binder particles, plastic particles, or other polymeric particles. In a final product, the powdery particles may form a coating layer, or a film layer. Typically, the coating layer is aimed to replace conventional paper coatings, and the film layer is aimed to replace conventional film layers, such as a plastic film on a paper substrate. When the powdery particles are applied on the web they are substantially dry; the moisture content of the powdery particles is preferably less than 15 wt-%.

The process arrangement is as follows: The web having a first side and a second side serves as a substrate on which the powdery layer is formed. At the second side of the web there is the rotating grounding electrode, which attracts the electrically charged powdery particles intended to be applied on the first side of the web. The grounding electrode is in a ground potential or another predetermined potential, which deviates from the zero potential. For example, if the powdery particles are treated by a negative corona the grounding electrode may have a positive potential. The rotating grounding electrode may be in contact or in close range with the second surface of the web. The grounding roll may also have an insulating surface layer to enhance the electric field.

The powdery particles are charged in a charging unit. The charging unit may comprise at least one corona charging electrode at the first side of the web, or the particles are charged by tribocharging. A combination of the corona charging and the tribocharging may be also used. The electrically charged powdery particles are applied on the web by blowing the particles from a feeding nozzle towards the web.

When there are electrode/s at the both sides of the web, and the electrodes at the first side of the web are in a different potential compared to electrodes at the second side of the web, the powdery particles are applied on the substrate in such a manner that the electrodes at the opposite sides of the substrate form an electric field in which the particles of the dry powder are blown through a feeding nozzle. The layer formed of the powdery particles is finished by a suitable manner in a final fixing device, for example by thermomechanical treatment, such as calendering. The substrate can be treated only one surface at a time, or both surfaces at the same time. It is also possible that two or more layers are formed one upon the other.

The web to be treated may advance in a continuous manner on the surface of the grounding roll during the process. The grounding roll may form a nip with a first hot roll belonging to the finishing unit, which at least partially melts a binder of the powdery material. The finishing can be finalized in the next nip/nips. The grounding roll and the following rolls can form a calender stack. The web in contact with the grounding roll is grounded or brought in a predetermined potential down to the nip formed by the grounding roll and the first hot roll. The finishing can also be finalized by using chemicals, or a suitable radiation, for example UV radiation, to fix the coating powder to the web.

BRIEF DESCRIPTION OF THE DRAWINGS

In the following, the method of the invention is explained by a drawing, which shows a schematic side view of a process step in which the grounding electrode of the invention is applied.

DESCRIPTION OF THE PREFERRED EMBODIMENTS

A web W to be treated, such as a paper or plastic web, runs between a rotating grounding roll 2 and a charging electrode 1. The web W is in contact with the grounding roll 2. The charging electrode 1 can be either positive or negative. The charging electrode 1 may be a corona charging electrode. Particles of a powdery material are charged by the electrode 1, and blown towards the web W by a feeding nozzle (not shown). The particles may include inorganic particles, binder particles, plastic particles, or other polymeric particles. The particles of the powdery material are attracted by the grounding roll 2, and thus a powdery layer is formed on the surface of the web W.

The powdery layer, which is adhered to the web W by electrostatic forces is fixed to the web in nips formed between the grounding roll 2 and a heated hard roll 3, and the heated hard roll 3 and a resilient roll 4. The web W is directly grounded down to the first nip but it is possible that the first heated hard roll 3 is in the same potential as the grounding roll 2. The powdery particles include binder particles, which melt in contact with the heated hard roll 3.

The invention is not restricted to the description above, but it may vary within the scope of the claims.

The invention claimed is:

1. A web coating device comprising:

a web having a first side and a second side opposite the first side, the web forming a substrate;

an electrically conducting roll forming a grounding electrode mounted for rotation and having an outermost insulating surface positioned engaged with the second side of the web;

a charging electrode positioned opposite the grounding electrode, and over the first side of the web and a layer of powder applied on the web where the web is engaged with the electrically conducting roll; and a heated roll, having an outer surface in nipping engagement with the electrically conducting roll, to define a nip therewith, wherein the web passes through the nip and the first side of the web and the layer of powder thereon engages the heated roll outer surface, the layer of powder forming a partly melted layer where it engages the heated roll.

2. The web and web coating device of claim 1, wherein the heated roll and the electrically conducting roll are arranged to be at the same potential.

3. The web and web coating device of claim 1, further comprising a resilient roll in nipping engagement with the heated roll and pressing the web and the layer of powder forming the partly melted layer against the heated roll.

4. The web coating device of claim 1 wherein the web comprises papermaking fibers.

5. A method for coating a web comprising the steps of:

passing a continuous web having a first side and a second side between a charging unit of powdery particles, the charging unit having a corona charging electrode, and a rotating electrically conductive grounding roll having an electrically insulating surface so that the web second side is in contact with the electrically insulating surface;

applying to the first side of the web a layer of powdery particles which are charged in the charging unit while the web second side is engaged against the insulating surface of the grounding roll, wherein the grounding roll is held at a selected potential; and a further step of at least partially melting a binder of the powdery particles to fix the coating powder to the web in a calender stack comprising the grounding roll at the selected potential in nipping engagement with a heated roll.

6. The method of claim 5, further comprising the step of charging the powdery particles by tribocharging before applying the layer of powdery particles to the first side of the web.

7. The method of claim 5, wherein the calender stack comprises the grounding roll, a resilient roll, and the heated roll therebetween.

8. The method of claim 5, wherein the further step comprises:

engaging the rotating electrically conductive grounding roll at a nip with the heated roll; and passing the web through the nip with the first side of the web and the layer of powdery particles thereon engaging an other surface of the heated roll, so that the layer of powderery particles forms a partly melted layer where it engages the heated roll.

9. The method of claim 8, wherein the heated roll and the electrically conductive grounding roll are at the same potential.

10. The method of claim 8, wherein the further step further comprises:

engaging the heated roll with a resilient roll at a nip; and passing the web and the layer of powdery particles forming the partly melted layer through the nip so as to press the web and the layer of powdery particles forming the partly melted layer against the heated roll.

11. The method of claim 8 wherein the continuous web comprises papermalcing fibers.

12. A method for coating a web comprising the steps of:

passing a continuous web having a first side and a second side between a charging unit which employs tribocharging to charge powdery particles, and a rotating electrically conductive grounding roll having an electrically insulating surface so that the web second side is in contact with the electrically insulating surface;

applying to the first side of the web a layer of powdery particles which are charged in the charging unit while the second side is engaged against the insulating surface of the grounding roll, wherein the grounding roll is held at a selected potential; and a further step of at least partially melting a binder of the layer of powdery particles to fix the coating powder to the web in a calender stack comprising the grounding roll and a heated roll.

13. The method of claim 12, wherein the calender stack comprises the grounding roll, a resilient roll, and the heated roll therebetween.

14. The method of claim 12, wherein the further step comprises:

engaging the rotating electrically conductive grounding roll at a nip with the heated roll; and passing the web through the nip with the first side of the web and the layer of powdery particles thereon engaging an outer surface of the heated roll, so that the layer of powdery particles forms a partly melted layer where it engages the heated roll.

15. The method of claim 14, wherein the heated roll and the electrically conductive grounding roll are at the same potential.

16. The method of claim 12, wherein the further step of further comprises:

engaging the heated roll with a resilient roll at a nip; and passing the web and the layer of powdery particles forming the partly melted layer through the nip so as to press the web and the layer of powder forming the partly melted layer against the heated roll.

17. The method of claim 12 wherein the continuous web comprises papermaking fibers.

* * * * *